US012599273B2

(12) United States Patent
Lien

(10) Patent No.: US 12,599,273 B2
(45) Date of Patent: Apr. 14, 2026

(54) BOUNCING CORE DEVICE, DETACHABLE CONNECTING DEVICE, AND PAPER TOWEL RACK

(71) Applicant: NINGBO CHSIRGA METAL PRODUCTS CO., LTD., Yuyao (CN)

(72) Inventor: Chen-Yu Lien, Yilan City (TW)

(73) Assignee: NINGBO CHSIRGA METAL PRODUCTS CO., LTD., Yuyao (CN)

( * ) Notice: Subject to any disclaimer, the term of this patent is extended or adjusted under 35 U.S.C. 154(b) by 165 days.

(21) Appl. No.: 18/772,533

(22) Filed: Jul. 15, 2024

(65) Prior Publication Data

US 2025/0359714 A1 Nov. 27, 2025

(30) Foreign Application Priority Data

May 21, 2024 (CN) ..... 202421114166.1
May 21, 2024 (CN) ..... 202421118536.9

(51) Int. Cl.
*A47K 10/38* (2006.01)
*A47K 10/18* (2006.01)
*A47K 10/32* (2006.01)

(52) U.S. Cl.
CPC ..... *A47K 10/3836* (2013.01); *A47K 10/18* (2013.01); *A47K 10/32* (2013.01); *A47K 2010/324* (2013.01)

(58) Field of Classification Search
CPC .... A47K 10/3836; A47K 10/32; A47K 10/16; A47K 10/18; A47K 2010/324; A47K 2010/3246; A47F 5/04; A47F 5/06
See application file for complete search history.

(56) References Cited

U.S. PATENT DOCUMENTS 4,487,376 A * 12/1984 Compton ..... A47K 10/3836 242/612
4,714,211 A * 12/1987 Hwang ..... B65B 67/085 242/588
4,720,053 A * 1/1988 Vance ..... A47K 10/3836 242/566
4,738,385 A * 4/1988 Bell ..... A47K 10/40 225/87
4,848,690 A * 7/1989 Lemoine ..... B65H 35/008 242/598.5
5,170,956 A * 12/1992 McTaggart ..... A47K 10/3836 242/422.4

(Continued)

*Primary Examiner* — Devin K Barnett

(57) ABSTRACT

The present disclosure relates to the technical field of daily necessities, and discloses a bouncing core device, a detachable connecting device, and a paper towel rack. The bouncing core device includes: moving members, disposed inside first recessed structures at a top of a base, the moving members being connected to the detachable connecting device; and a lateral moving member, disposed at the position where the moving members are located, the lateral moving member being configured to move left and right, and first side faces of the lateral moving member being arranged opposite to second side faces of the first recessed structures. Due to arrangement of the bouncing core device provided by the present disclosure, a smooth detachable connection between a decontamination sprayer and the base is achieved, and the user experience of the paper towel rack is improved.

20 Claims, 16 Drawing Sheets

(56) References Cited

U.S. PATENT DOCUMENTS 6,832,739 B1 * 12/2004 Kraus ..... A47K 10/3836 242/422.5
7,140,573 B1 * 11/2006 Jerstroem ..... A47K 10/3836 242/597.6
7,401,749 B2 * 7/2008 Yang ..... A47K 10/40 242/597.7
7,604,195 B1 * 10/2009 Lai ..... B65B 59/003 242/396.5
D672,590 S * 12/2012 Yang ..... D6/521
D761,039 S * 7/2016 Locker ..... D6/521
9,993,122 B2 * 6/2018 Bowen ..... A47K 10/3836
10,421,632 B2 * 9/2019 Cain ..... B65H 16/04
D935,215 S * 11/2021 Liang ..... D6/521
D980,644 S * 3/2023 Lien ..... D6/522
D1,028,560 S * 5/2024 Kamenstein ..... D6/521
D1,049,691 S * 11/2024 Wei ..... D6/521
D1,061,076 S * 2/2025 Yang ..... D6/521
D1,063,438 S * 2/2025 Lien ..... D6/518
D1,078,323 S * 6/2025 Lian ..... D6/521
2006/0219837 A1 * 10/2006 Yang ..... A47K 10/3836 242/597.4
2006/0284001 A1 * 12/2006 Paradise ..... A47K 10/3836 242/597.7
2007/0176043 A1 * 8/2007 Yu ..... A47K 10/3836 242/597.7
2008/0011782 A1 * 1/2008 Sidman ..... A47K 5/12 222/192
2011/0233255 A1 * 9/2011 Tiamson ..... A47K 10/3836 225/77
2014/0339281 A1 * 11/2014 Flocchini ..... A47K 10/3836 225/106
2020/0146518 A1 * 5/2020 Kamenstein ..... A47K 10/3836
2020/0268220 A1 * 8/2020 Hong ..... A47K 10/22
2021/0321833 A1 * 10/2021 Madden ..... A47K 10/3836
2022/0183509 A1 * 6/2022 Yang ..... A47K 10/38
2023/0172404 A1 * 6/2023 Brown ..... A47K 10/3836 242/590
2023/0414046 A1 * 12/2023 Li ..... A47K 10/38
2024/0277190 A1 * 8/2024 Dunn ..... A47K 10/3836

* cited by examiner

BOUNCING CORE DEVICE, DETACHABLE CONNECTING DEVICE, AND PAPER TOWEL RACK

CROSS REFERENCE TO RELATED APPLICATIONS

The present application claims the benefit of Chinese Patent Application Nos. 202421114166.1 and 202421118536.9 filed on May 21, 2024. All the above are hereby incorporated by reference in their entirety.

TECHNICAL FIELD

The present disclosure relates to the technical field of daily necessities, and more particularly, to a bouncing core device, a detachable connecting device, and a paper towel rack.

BACKGROUND

With the continuous progress of science and technology and the continuous improvement of people's living standards, the integration and convenience of daily necessities have also been improved. A paper towel rack is an integration device that integrates the use of roll paper or paper towel with a decontamination sprayer.

The existing paper towel rack generally includes a base and a molding of a decontamination sprayer. The decontamination sprayer is designed as a stand column by molding. The roll paper is sleeved outside the decontamination sprayer and placed on the base. The base is in a detachable connection with the decontamination sprayer. The decontamination sprayer is pressed downward so as to be separated from the base, which enables the decontamination sprayer to be used to spray the dirt; then, part of the roll paper is torn off for wiping off the dirt; and finally, the decontamination sprayer is put back onto the base and pressed again, so that the decontamination sprayer is connected to the base.

In order to realize the above function, a detachable connecting device needs to be disposed between the base and the stand column-shaped decontamination sprayer, but the existing detachable connecting device has obvious frustration during use, and more importantly, when the stand column-shaped decontamination sprayer is pressed downward, the decontamination sprayer is easy to get stuck and thus cannot be separated from the base, which seriously affects the user experience of the paper towel rack.

SUMMARY

To address at least one aspect of the aforementioned issues, the present disclosure provides a bouncing core device, a detachable connecting device, and a paper towel rack. The bouncing core device is configured for the detachable connecting device disposed between a stand column of the paper towel rack and a base. The bouncing core device includes: moving members, disposed inside first recessed structures at a top of the base, the moving members being connected to the detachable connecting device; first elastic deformation members, configured to push the moving members upwards; a lateral moving member, disposed at the position where the moving members are located, the lateral moving member being configured to move left and right, and first side faces of the lateral moving member being arranged opposite to second side faces of the first recessed structures;

raised structures, formed at the first side faces or the second side faces; and second recessed structures, formed at the second side faces or the first side faces, each of the second recessed structures being internally provided with a V-shaped bulge, bending portions of the V-shaped bulges being arranged facing upward or downward, and the raised structures being arranged inside the second recessed structures, where the second recessed structures are configured to limit the raised structures to move only clockwise or counterclockwise around edges of the V-shaped bulges, and a detachable connection between the stand column and the base can be achieved by ascending and descending of the moving members relative to the first recessed structures. Due to arrangement of the bouncing core device provided by the present disclosure, a smooth detachable connection between a decontamination sprayer and the base is achieved, and the user experience of the paper towel rack is improved.

Preferably, the cross sections of the raised structures are rhombus-shaped, the cross sections of the raised structures are vertical planes perpendicular to the protruding directions of the raised structures, and the length directions of the raised structures are vertically arranged.

Preferably, the second recessed structures are polygonal recessed structures, and each of the second recessed structures is internally provided with a guide bulge; the guide bulges are connected to side walls of the second recessed structures, the guide bulges are arranged close to openings of the V-shaped bulges, and the guide bulges protrude towards the openings of the V-shaped bulges; and the guide bulges are configured to enable the raised structures to enter the bending portions of the V-shaped bulges.

Preferably, there are two raised structures and two second recessed structures; each of the raised structures is arranged inside the corresponding second recessed structure; there are two first side faces arranged at are two opposite side faces of the lateral moving member; and there are two second side faces arranged in one-to-one correspondence with the first side faces.

Preferably, each of the moving members is provided with a long strip-shaped through hole, and the long strip-shaped through hole extends horizontally; the lateral moving member is placed inside the long strip-shaped through holes, and the two raised structures are respectively formed at the corresponding first side faces and extend out of the long strip-shaped through holes; and the two second recessed structures are respectively formed at the corresponding second side faces.

Preferably, the bending portions of the V-shaped bulges are arranged facing upward.

Preferably, the base includes a mounting base, and a mounting column fixedly disposed on the mounting base, where the mounting column is sleeved with a paper towel roll in a detachable manner, the mounting base is provided with a pressing arm component for being pressed on one side of the paper towel roll, a pressing block for being pressed on one side of the paper towel roll is disposed at an upper part of the pressing arm component, and a lower part of the pressing arm component is hinged to the mounting base; and an elastic member is disposed between the pressing arm component and the mounting base, and the pressing arm component is driven by the elasticity of the elastic member to rotate towards one side of the paper towel roll, so that the pressing block is pressed against the paper towel roll.

Preferably, the pressing arm component includes a pressing rod, a lower part of the pressing rod is hinged to the mounting base, and the pressing block is connected to an upper part of the pressing rod.

Preferably, the pressing block is hinged to the upper part of the pressing rod.

Preferably, a hinge block is fixedly disposed at the lower part of the pressing rod, and the hinge block is hinged to the mounting base.

Preferably, the elastic member is connected between the hinge block and the mounting base, the elastic member is a tension spring, one end of the elastic member is connected to the hinge block, and the other end of the elastic member is connected to the mounting base.

Preferably, the hinge block is in an inverted triangle, and the triangle formed by the hinge block has a first apical angle portion, a second apical angle portion, and a base angle portion; a lower end of the pressing rod is connected to the first apical angle portion; one end of the elastic member is connected to the second apical angle portion; and the base angle portion is hinged to the mounting base.

Preferably, hinge shafts are disposed on the hinge block, hinge plates are disposed on the mounting base, and hinge grooves corresponding to the hinge shafts are formed on the hinge plates.

Preferably, convex ribs are disposed on the sides of the hinge block close to the hinge plates, and the hinge plates are provided with guide slopes for guiding the hinge shafts into the hinge grooves.

Preferably, the hinge block is provided with a first inclined surface, the mounting base is provided with a second inclined surface abutting against the first inclined surface for limiting, the pressing rod is cylindrical, and the mounting base is provided with an arc-shaped concave surface abutting against a side wall of the pressing rod for limiting; and the mounting column is in a detachable threaded connection with the mounting base by ways of a first bolt disposed at a bottom of the mounting column, and the stand column is in a detachable threaded connection with the mounting column by ways of a second bolt disposed at a bottom of the stand column.

In addition, the present disclosure further provides a detachable connecting device, which is configured to achieve a detachable connection between the stand column of the paper towel rack and the base. The detachable connecting device includes: a retaining eaves, formed at a bottom of the stand column; two clamping claws, respectively disposed at tops of the moving members of the bouncing core device according to any one of the claims, the clamping claws being hinged to the moving members, and the retaining eaves being hooked by closing the two clamping claws; and second elastic deformation members, disposed at positions where the clamping claws are located, the second elastic deformation members being configured to keep the two clamping claws open, where when the moving members move downward relative to the first recessed structures at a top of the stand column, side walls of the first recessed structures are configured to close the two clamping claws.

Preferably, each of the moving members includes two vertical plates; the two clamping claws are sandwiched between the two vertical plates, respectively; and the lateral moving member is disposed between the two vertical plates.

Preferably, the detachable connecting device further includes a left housing and a right housing, where the left housing and the right housing are separately in a detachable connection with the top of the base, and the left housing and the right housing are buckled together; the first recessed structures are respectively recessed downward from tops of the left housing and the right housing; and the moving members are disposed between the left housing and the right housing.

In addition, the present disclosure also provides a paper towel rack, including the detachable connecting device.

Compared with the prior art, the V-shaped bulges are formed inside the second recessed structures, and the raised structures are moved to the openings of the V-shaped bulges and can be stuck in the bending portions of the V-shaped bulges, so that the heights of the moving members relative to the first recessed structures are reduced, and the stand column and the base are ensured to be connected together; then, due to the characteristic that the second recessed structures are configured to limit the raised structures to move only clockwise or counterclockwise around the edges of the V-shaped bulges, it is ensured that the raised structures can smoothly detach from the openings of the V-shaped bulges, which enables the moving members to protrude from the first recessed structures, and ensures the separation of the stand column from the base; and therefore, the detachable connection between the base and the stand column is realized.

Meanwhile, the lateral moving member can move left and right, and the moving members can move up and down, so that the raised structures can perform a combined motion, and the raised structures can be further enabled to move arbitrarily in the second recessed structures; and therefore, the movement flexibility of the raised structures in the second recessed structures is improved, and the situation of jamming of the stand column caused by the raised structures getting stuck is prevented.

In this way, due to arrangement of the bouncing core device provided by the present disclosure, a smooth detachable connection between a decontamination sprayer and the base is achieved, and the user experience of the paper towel rack is improved.

Figure 1:
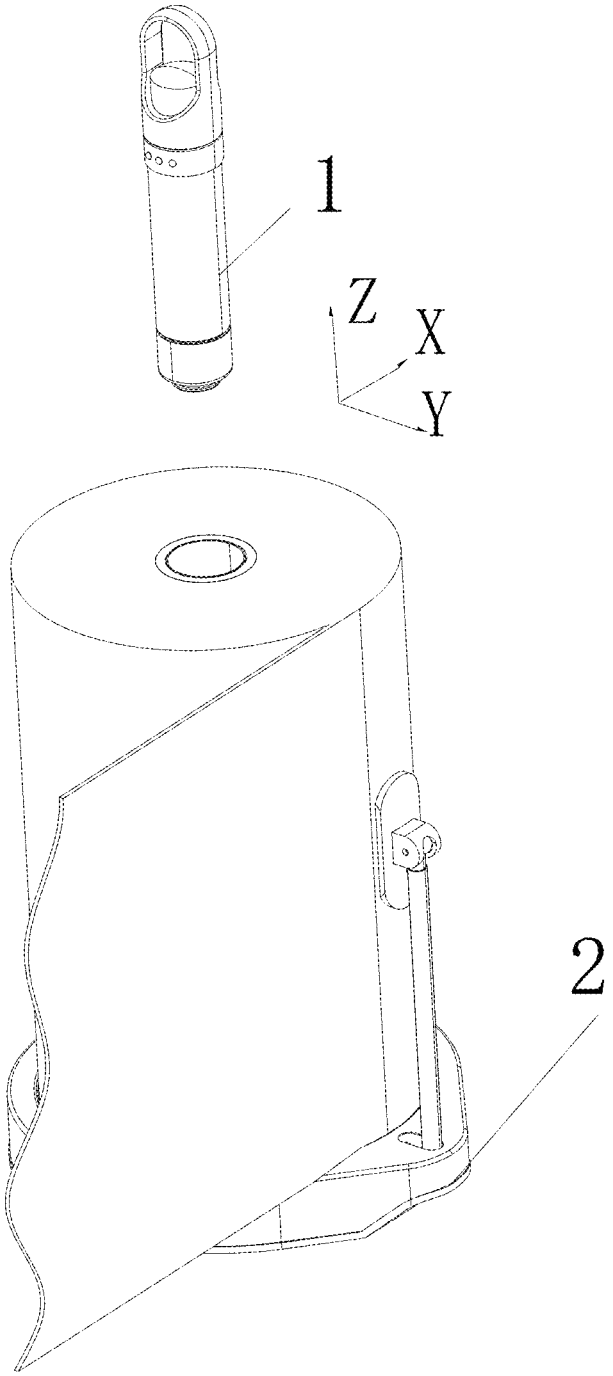
FIG. 1 is a schematic structural diagram of a paper towel rack according to an embodiment of the present disclosure.
Figure 2:
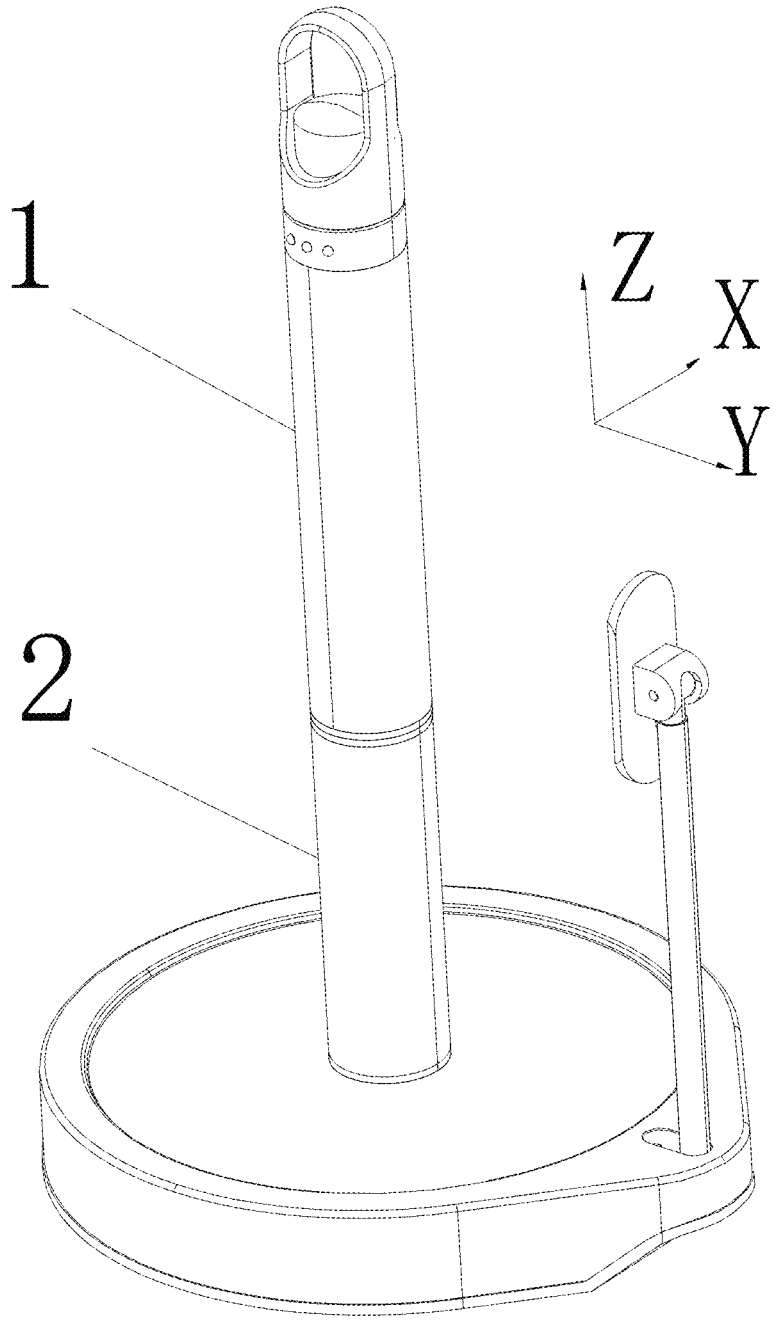
FIG. 2 is another schematic structural diagram of a paper towel rack according to an embodiment of the present disclosure.
Figure 3:
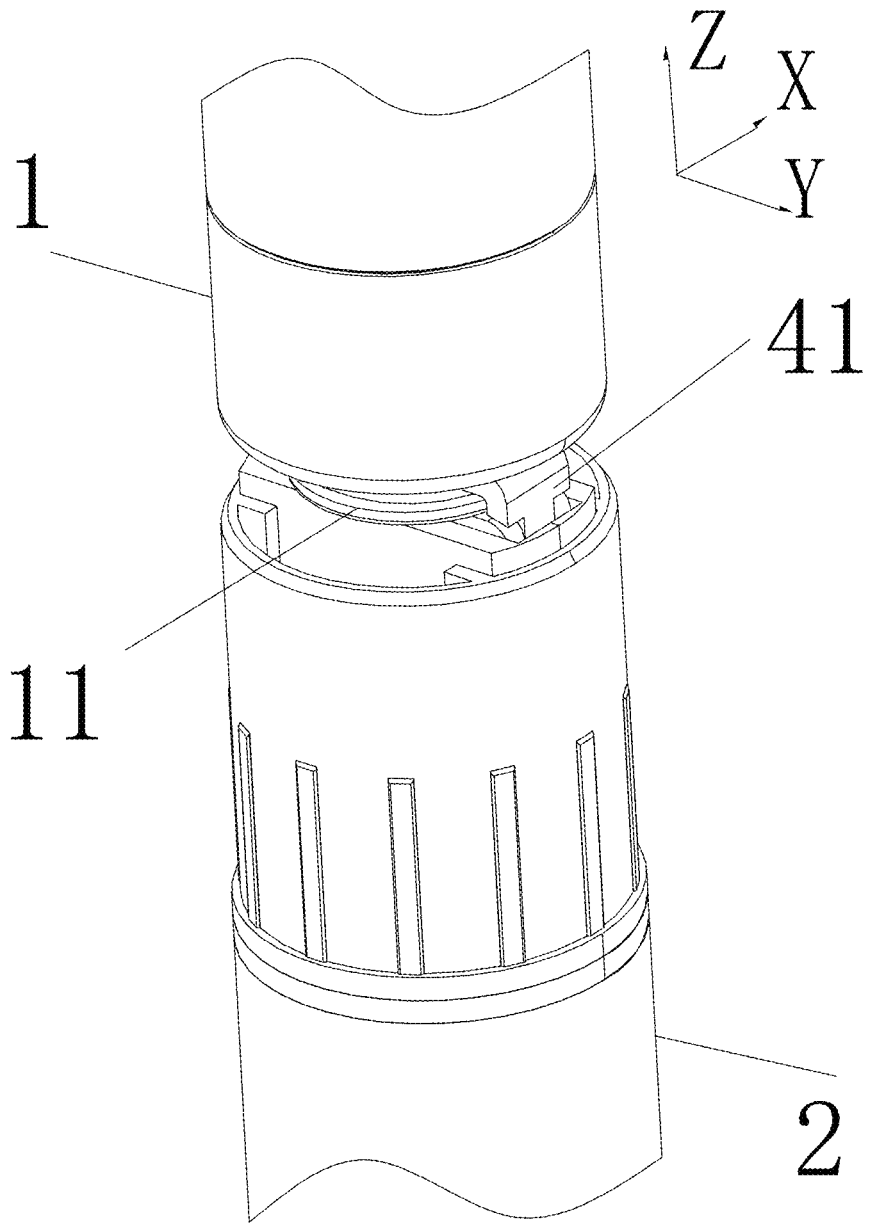
FIG. 3 is a schematic structural diagram of a detachable connecting device according to an embodiment of the present disclosure.
Figure 4:
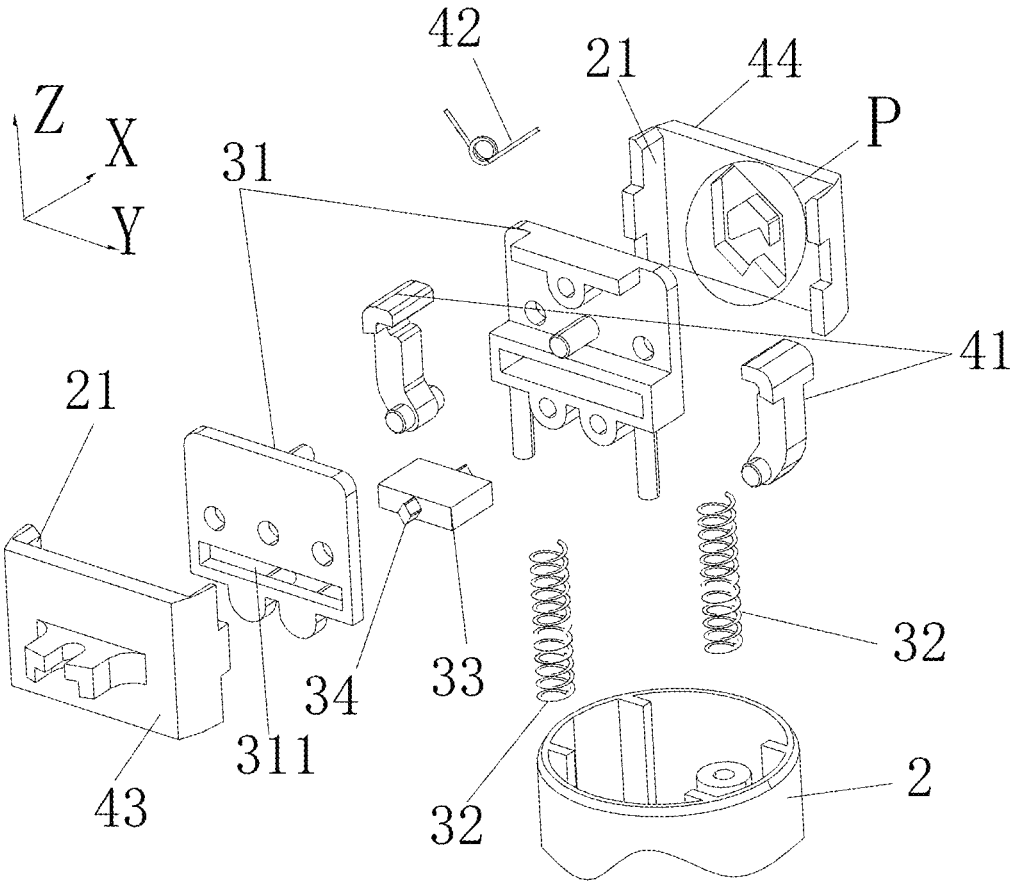
FIG. 4 is a schematic exploded view of a bouncing core device according to an embodiment of the present disclosure.
Figure 5:
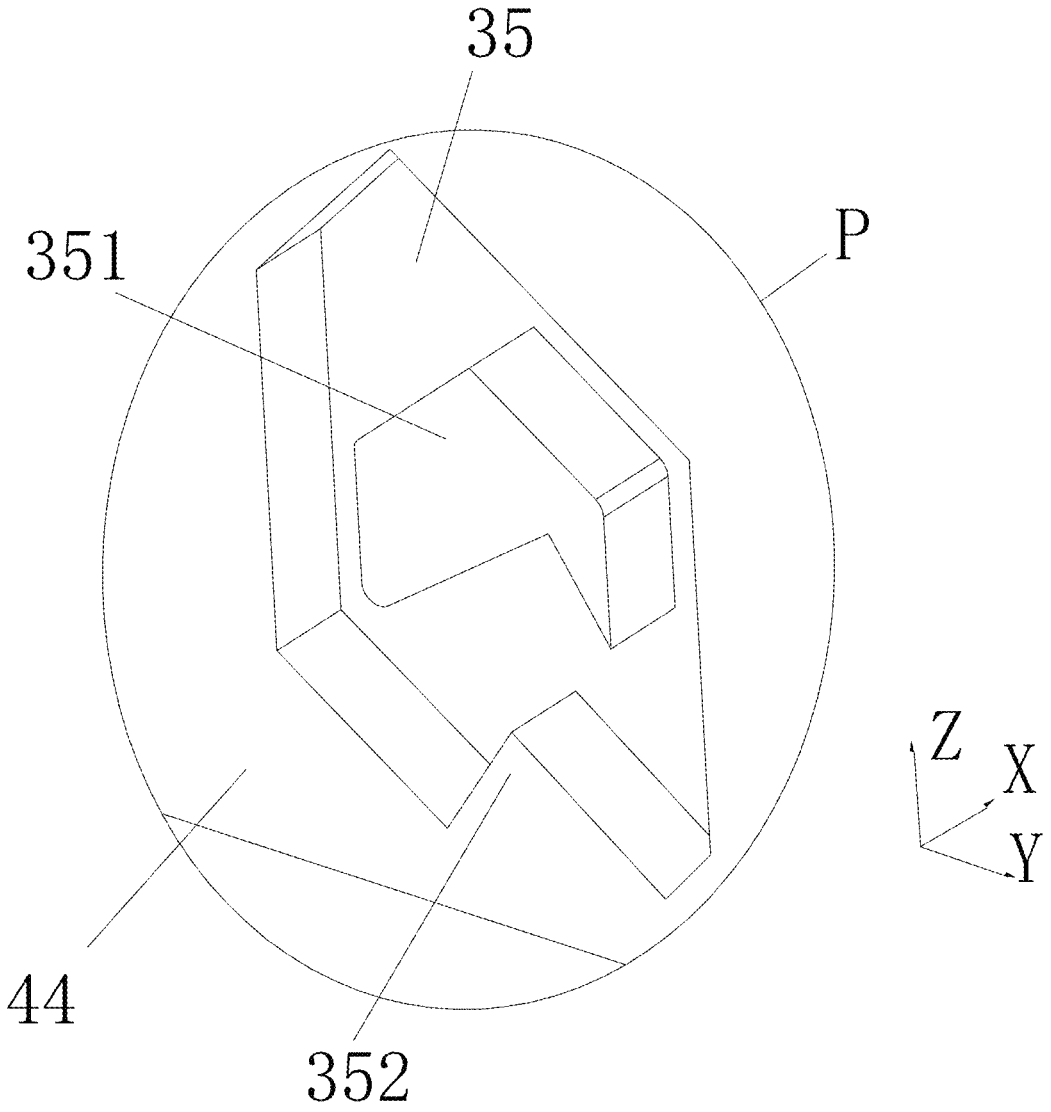
FIG. 5 is an enlarged view of Part P in FIG. 4.
Figure 6:
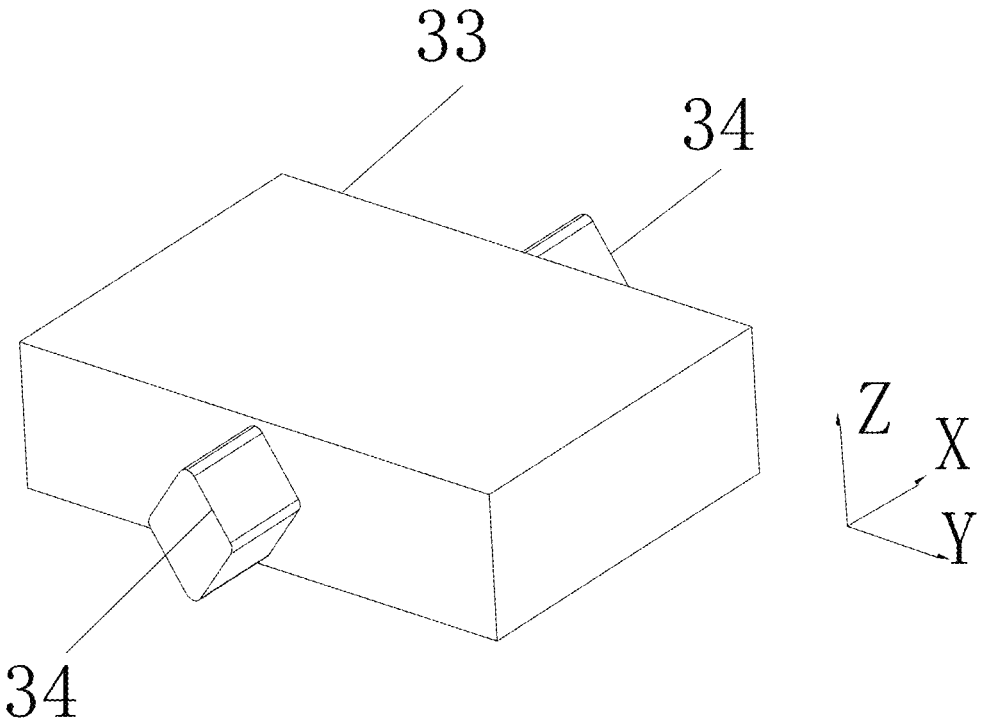
FIG. 6 is a schematic structural diagram of a lateral moving member according to an embodiment of the present disclosure.
Figure 7:
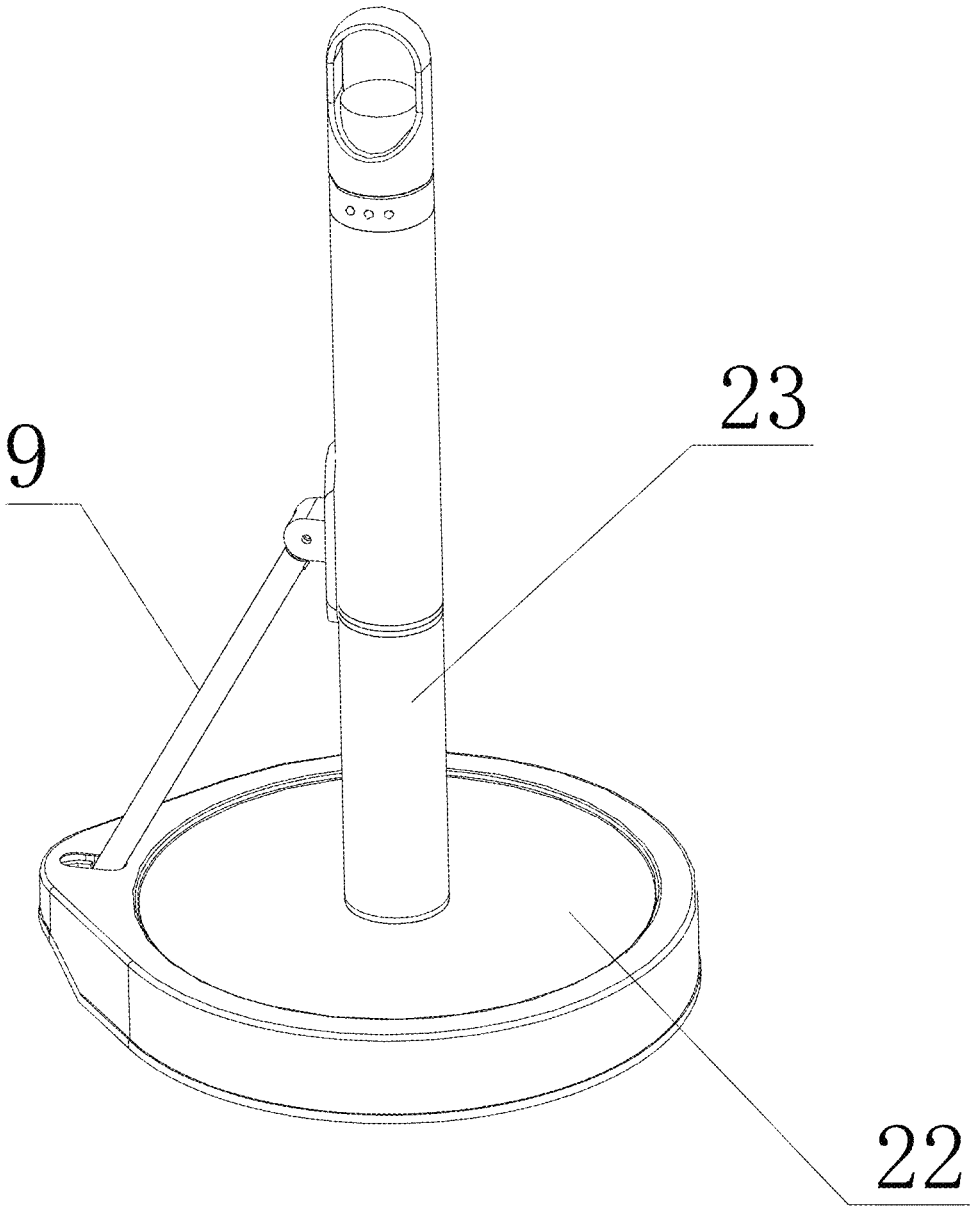
FIG. 7 is a three-dimensional view of a paper towel rack according to the present disclosure.
Figure 8:
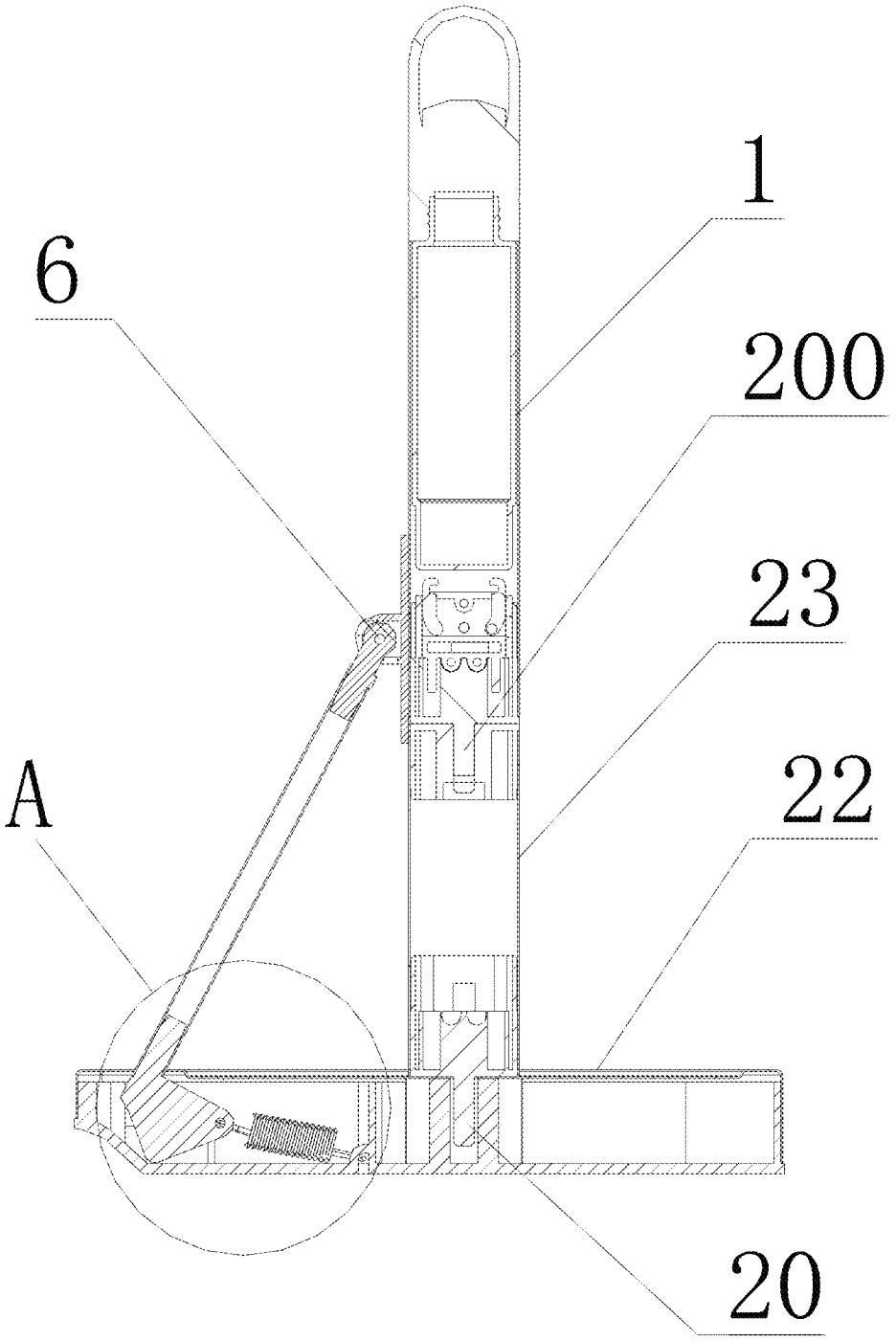
FIG. 8 is a sectional view of a paper towel rack according to the present disclosure.
Figure 9:
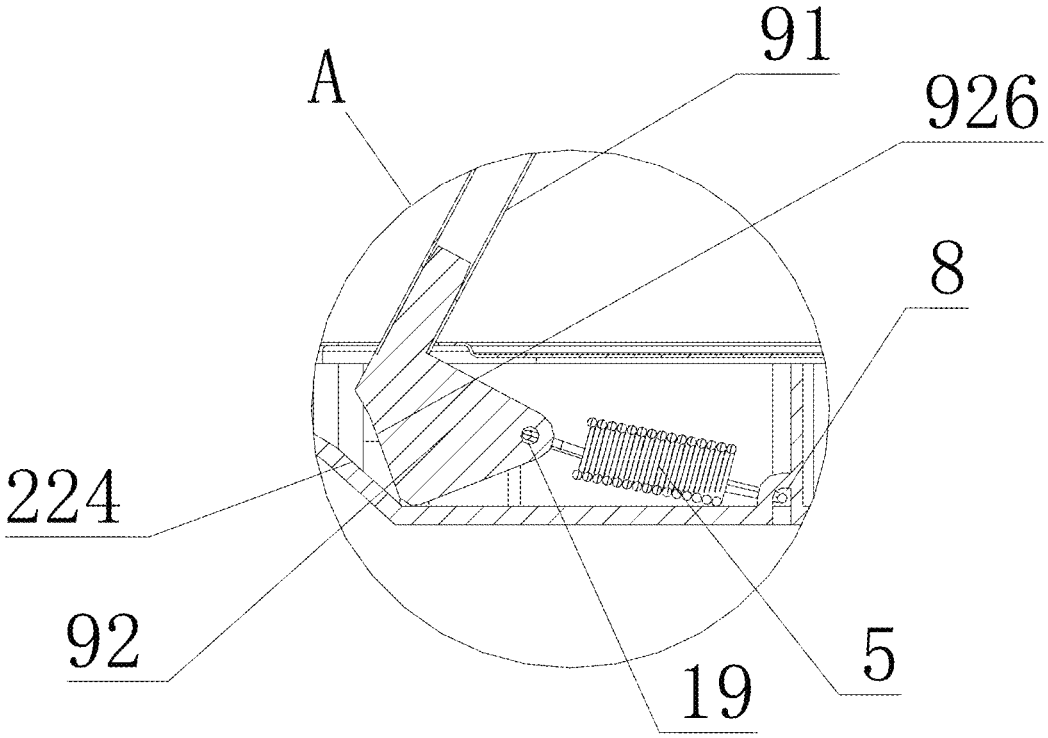
FIG. 9 is an enlarged view of Part A in FIG. 8.

The corresponding component names denoted by reference numerals in the drawings are as follows: 1 denotes a stand column; 11 denotes a retaining eaves; 2 denotes a base; 21 denotes first recessed structures; 31 denotes moving members; 311 denotes long strip-shaped through holes; 32 denotes first elastic deformation members; 33 denotes a lateral moving member; 34 denotes raised structures; 35 denotes second recessed structures; 351 denotes V-shaped bulges; 352 denotes guide bulges; 41 denotes clamping claws; 42 denotes second elastic deformation members; 43 denotes a left housing; 44 denotes a right housing; 22 denotes a mounting base; 221 denotes hinge plates; 222 denotes hinge grooves; 223 denotes guide slopes; 224 denotes a second inclined surface; 225 denotes an arc-shaped concave surface; 23 denotes a mounting column; 30 denotes a paper towel roll; 301 denotes a reel; 302 denotes roll paper; 321 denotes a drawn portion; 322 denotes an undrawn portion; 9 denotes a pressing arm component; 901 denotes a pressing block; 9011 denotes an arc-shaped concave part; 91 denotes a pressing rod; 92 denotes a hinge block; 921 denotes a first apical angle portion; 922 denotes a second apical angle portion; 923 denotes a base angle portion; 924 denotes hinge shafts; 925 denotes convex ribs; 926 denotes a first inclined surface; 5 denotes an elastic member; 6 denotes a rotating shaft; 7 denotes a hinge member; 8 denotes a first hook groove; 19 denotes a second hook groove; 20 denotes a first bolt; and 200 denotes a second bolt.

DETAILED DESCRIPTION

In order to make the above objects, features and advantages of the present disclosure more obvious and easy to understand, specific embodiments of the present disclosure will be described in detail with reference to the accompanying drawings.

In the description of the present disclosure, it should be understood that the orientations or positional relationships indicated by the terms "upper", "lower" and the like are based on the orientations or positional relationships when the product is normally used.

The terms "first" and "second" are only used for descriptive purposes, and cannot be understood as indicating or implying relative importance or implicitly indicating the number of indicated technical features. Thus, the features defined with "first" and "second" may explicitly or implicitly include at least one of these features.

Referring to FIG. 1 to FIG. 6, this embodiment provides a bouncing core device, which is configured for a detachable connecting device disposed between a stand column 1 of a paper towel rack and a base 2. The bouncing core device includes: moving members 31, disposed inside first recessed structures 21 at a top of the base 2, the moving members 31 being connected to the detachable connecting device; first elastic deformation members 32, configured to push the moving members 31 upwards; a lateral moving member 33, disposed at the position where the moving members 31 are located, the lateral moving member 33 being configured to move left and right, and first side faces of the lateral moving member 33 being arranged opposite to second side faces of the first recessed structures 21; raised structures 34, formed at the first side faces or the second side faces; and second recessed structures 35, formed at the second side faces or the first side faces, each of the second recessed structures 35 being internally provided with a V-shaped bulge 351, bending portions of the V-shaped bulges 351 being arranged facing upward or downward, and the raised structures 34 being arranged inside the second recessed structures 35. Where the second recessed structures 35 are configured to limit the raised structures 34 to move only clockwise or counterclockwise around edges of the V-shaped bulges 351, and a detachable connection between the stand column 1 and the base 2 can be achieved by ascending and descending of the moving members 31 relative to the first recessed structures 21.

It should be noted that, the stand column 1 in this embodiment is also referred to as a decontamination sprayer; and in this embodiment, it is simply referred to as the stand column 1 for convenience of description.

It should be noted that the detachable connecting device in this embodiment may be a clamping structure, and the clamping structure adopts a hinged connection to achieve the clamping and releasing states, thus correspondingly realizing a detachable connection between the stand column 1 and the base 2. The clamping structure is disposed at tops of the moving members 31 and connected to the moving members 31. The clamping structure is enabled to be hinged and swung by ascending and descending of the moving members 31 in the first recessed structures 21, thereby opening and closing, or clamping.

It should be noted that the shape of each of the second recessed structures 35 here may be a polygon, such as a triangle or a pentagon, so as to limit the raised structures 34 to move only around external edges of the V-shaped bulges 351; and in order to make the raised structures 34 only move clockwise or counterclockwise, the edge profiles of the second recessed structures 35 can be adjusted to allow these edge profiles to be properly inclined, and the raised structures 34 are thereby blocked from returning along the original path, which are conventional designs in the art.

Specifically, the shape of each of the second recessed structures 35 may be a triangle, or may be trilateral, as the V-shaped bulges 351 are approximately triangular. At this time, when the raised structures 34 move to left and right ends of the V-shaped bulges 351, the corners will directly guide the raised structures 34 into openings of the V-shaped bulges 351, thereby preventing the raised structures 34 from "flowing back", and ensuring that the raised structures can only move clockwise or counterclockwise; alternatively, the shape of each of the second recessed structures 35 may also be pentagonal, and at this time, outermost edges of two arm bodies of each of the V-shaped bulges 351 may be edges extending along the vertical direction; and the vertically extending edges are matched with the pentagonal second recessed structures 35 so as to guide the raised structures 34 to continue to move clockwise or counterclockwise. Of course, in order to ensure that the raised structures 34 smoothly enter openings of the V-shaped bulges 351, guiding bulges may also be provided at the edges of the second recessed structures 35, which will be described in detail later in this embodiment.

In addition, it should be noted that when the raised structures 34 are disposed at the first side faces of the lateral moving member 33, the second recessed structures 35 are disposed at the second side faces of the first recessed structures 21. On the contrary, when the raised structures 34 are disposed at the first recessed structures 21, the second recessed structures 35 are disposed at the lateral moving member 33, as long as the raised structures 34 can move in the second recessed structures 35.

In addition, bending portions of the V-shaped bulges 351 are arranged facing upward or downward depending on where the raised structures 34 are disposed. If the raised structures 34 are disposed at the first recessed structures 21, the bending portions of the V-shaped bulges 351 are arranged facing downward, that is, the openings of the V-shaped bulges are formed upward. If the raised structures 34 are disposed on the lateral moving member 33, the bending portions of the V-shaped bulges 351 are arranged facing upward, that is, the openings of the V-shaped bulges are formed downward.

In addition, it should be noted that the first elastic deformation members 32 in this present embodiment may be torsion springs or springs, as long as they can push the moving members 31 upwards.

In this embodiment, by changing an internal bouncing core structure of the detachable connecting device, the situation that the stand column 1 (also referred to as the decontamination sprayer, which is referred to as the stand column 1 for short for convenience of description in this embodiment) is easy to get stuck and thus cannot be separated from the base 2 is avoided.

Specifically, the lateral moving member 33 can move left and right relative to the moving members 31, and the moving members 31 can move up and down under the extrusion of the first elastic deformation members 32 and the stand column 1, which enables the lateral moving member 33 to perform a combined motion within a vertical plane. Therefore, arrangement of the raised structures 34 or the second recessed structures 35 at the first side faces of the lateral moving member 33 can achieve arbitrary motion of the raised structures 34 in the second recessed structures 35, including the motion around the V-shaped bulges 351. In this way, during the process of removing the stand column 1 and pressing the stand column down on the moving members 31, the raised structures 34 can only move along outer contours of the V-shaped bulges 351 in the second recessed structures 35, and when reaching the openings of the V-shaped bulges 351, that is, backs of the bending portions of the V-shaped bulges 351, since the first elastic deformation members 32 always push the moving members 31 upwards, the raised structures 34 get stuck in the openings of the V-shaped bulges 351 and cannot be detached; at this time, the raised structures 34 cannot continue to move, so that the moving members 31 move to bottoms of the first recessed structures 21, and the clamping structure of the detachable connecting device clamps the stand column 1 tightly; and therefore, the stand column 1 and the base 2 are connected together. When it is necessary to remove the stand column 1, the stand column 1 continues to be pressed downwards, making the pressing force greater than the elastic force of the first elastic deformation members 32 pushing upwards. Due to the limitation of the second recessed structures 35, the raised structures 34 can only leave from the openings of the V-shaped bulges 351 and continue to move clockwise or counterclockwise, so that the moving members 31 are enabled to move upward. Correspondingly, the clamping structure opens and separates from the stand column 1, so as to separate the stand column 1 from the base 2.

In this way, according to the present disclosure, the V-shaped bulges 351 are formed inside the second recessed structures 35, and the raised structures 34 are moved to the openings of the V-shaped bulges 351 and can be stuck in the bending portions of the V-shaped bulges 351, so that the heights of the moving members 31 relative to the first recessed structures 21 are reduced, and the stand column 1 and the base 2 are ensured to be connected together; then, due to the characteristic that the second recessed structures 35 are configured to limit the raised structures 34 to move only clockwise or counterclockwise around the edges of the V-shaped bulges 351, it is ensured that the raised structures 34 can smoothly detach from the openings of the V-shaped bulges 351, which enables the moving members 31 to protrude from the first recessed structures 21, and ensures the separation of the stand column 1 from the base 2; and therefore, the detachable connection between the base 2 and the stand column 1 is realized.

Meanwhile, the lateral moving member 33 can move left and right, and the moving members 31 can move up and down, so that the raised structures 34 can perform a combined motion, and the raised structures 34 can be further enabled to move arbitrarily in the second recessed structures 35; and therefore, the movement flexibility of the raised structures 34 in the second recessed structures 35 is improved, and the situation of jamming of the stand column 1 caused by the raised structures 34 getting stuck is prevented.

In this way, due to arrangement of the bouncing core device provided by the present disclosure, a smooth detachable connection between the decontamination sprayer and the base 2 is achieved, and the user experience of the paper towel rack is improved.

Further, the cross sections of the raised structures 34 are rhombus-shaped, the cross sections of the raised structures 34 are vertical planes perpendicular to the protruding directions of the raised structures 34, and the length directions of the raised structures 34 are vertically arranged.

The raised structures 34 are set to be rhombus-shaped, and the length directions of the raised structures are arranged vertically. Due to the feature that the rhombus is an elongated strip, the raised structures 34 are enabled to more easily enter and exit the openings of the V-shaped bulges 351, and the flexibility of the movement of the raised structures 34 is improved.

Further, the second recessed structures 35 are polygonal recessed structures, and each of the second recessed structures 35 is internally provided with a guide bulge 352; the guide bulges 352 are connected to side walls of the second recessed structures 35, the guide bulges 352 are arranged close to the openings of the V-shaped bulges 351, and the guide bulges 352 protrude towards the openings of the V-shaped bulges 351; and the guide bulges 352 are configured to enable the raised structures 34 to enter the bending portions of the V-shaped bulges 351.

Preferably, the guide bulges 352 are triangular, and the protruding directions of the guide bulges 352 point to the openings of the V-shaped bulges 351. For example, when the bending portions of the V-shaped bulges 351 are formed downwards, the guide bulges 352 are located above the V-shaped bulges 351 and disposed facing downward. On the contrary, when the bending portions of the V-shaped bulges 351 are formed upwards, the guide bulges 352 are located under the V-shaped bulges 351 and disposed facing upward.

Moreover, two side walls of the triangle of each of the guide bulges 352 are respectively a lead-in side wall and a lead-out side wall. When the stand column 1 is used to press the moving members 31 downwards, the raised structures 34 are enabled to move to the highest points or the lowest points in the second recessed structures 35. At this time, the raised structures 34 move to the sides of the openings of the V-shaped bulges 351 and also move to the sides of the guide bulges 352. By this time, it is no longer possible to press down on the stand column 1. Then, when the stand column 1 is lifted, the raised structures 34 first come into contact with the lead-in side walls and move along the lead-in side walls into the openings of the V-shaped bulges 351; and after that, the moving members 31 are prevented from moving upward by the bending portions of the V-shaped bulges 351, so that the clamping structure clamps the stand column 1 tightly. When the stand column 1 is separated, the stand column 1 is pressed downwards, and the moving members 31 synchronously drive the raised structures 34 to continue to move clockwise or counterclockwise. At this time, the raised structures 34 are out of contact with the bending portions of the V-shaped bulges 351 under the pressing action; and the raised structures 34 are enabled to be in contact with the lead-out side walls under the pressing action of the stand column 1, and leave the openings of the V-shaped bulges 351 under the guidance of the lead-out side walls.

Further, there are two raised structures 34 and two second recessed structures 35; each of the raised structures 34 is arranged inside the corresponding second recessed structure 35; there are two first side faces arranged at two opposite side faces of the lateral moving member 33; and there are two second side faces arranged in one-to-one correspondence with the first side faces.

Due to arrangement of the two raised structures 34 and the two second recessed structures 35, in the case where the stand column 1 and the base 2 are connected together, especially the stand column 1 is pulled upward, the gravity of the base 2 and the roll paper applied onto the moving members 31 is evenly distributed to the two raised structures 34 and the two second recessed structures 35, and thus the pulling force applied onto each of the raised structures 34 is reduced.

Further, each of the moving members 31 is provided with a long strip-shaped through hole 311, and the long strip-shaped through hole 311 extends horizontally; the lateral moving member 33 is placed inside the long strip-shaped through holes 311, and the two raised structures 34 are respectively formed at the corresponding first side faces and extend out of the long strip-shaped through holes 311; and the two second recessed structures 35 are respectively formed at the corresponding second side faces.

Through the long strip-shaped through holes 311, the lateral moving member 33 and the moving members 31 are easily and simply assembled.

Further, the bending portions of the V-shaped bulges 351 are arranged facing upward.

Referring to FIG. 7 to FIG. 16, the base 2 includes a mounting base 22 and a mounting column 23 fixedly disposed on the mounting base 22, where the mounting base 22 is in a shape of a hollow disc, the mounting column 23 may be in a detachable threaded connection with the mounting base 22 by ways of a first bolt 20 disposed at a bottom of the mounting column, and the stand column 1 may be in a detachable threaded connection with the mounting column 23 by ways of a second bolt 200 disposed at a bottom of the stand column, making it easy to disassemble, assemble, and transport. The mounting column 23 is cylindrical in shape; the mounting column 23 is sleeved with a paper towel roll 30 in a detachable manner; the paper towel roll 30 includes a reel 301 and roll paper 302, where the reel 301 is provided with an inner hole, the diameter of the inner hole is slightly larger than the diameter of the mounting column 23, and the mounting column 23 is detachably inserted into the inner hole; the mounting base 22 is provided with a pressing arm component 9 for being pressed on one side of the paper towel roll 30, and a pressing block 901 for being pressed on one side of the paper towel roll 30 is disposed at an upper part of the pressing arm component 9; an arc-shaped concave part 9011 is provided at one side of the pressing block 901 close to the paper towel roll 30, which makes the pressing block 901 more closely fit the paper towel roll 30 and increases the fitting area so as to press on the paper towel roll 30 and generate friction force; the direction of the friction force generated by the pressing block 901 on the paper towel roll 30 is opposite to the direction of tearing the paper towel roll 30; a lower part of the pressing arm component 9 is hinged to the mounting base 22; and an elastic member 5 is disposed between the pressing arm component 9 and the mounting base 22, and the pressing arm component 9 is driven by the elasticity of the elastic member 5 to rotate towards one side of the paper towel roll 30, so that the pressing block 901 is pressed against the paper towel roll 30. A paper towel roll pressing arm mechanism and the paper towel rack provided by the present disclosure are simple in structure and low in production cost. The pressing arm component is pressed against one side of the paper towel roll by the elasticity of the elastic member, which generates friction force between the paper towel roll and the pressing arm component, and makes it difficult for the paper towel roll to continue rotating due to inertia when torn, thus avoiding waste caused by bringing out overmuch paper towel, and making it more convenient to use. When in use, one end of the roll paper 302 is firstly pulled out at a slower speed to form a drawn portion 321, and the drawing force drives the reel 301 to rotate around the axis of the mounting column 23. When the required length is drawn out, since the pressing arm component presses an undrawn portion 322 of the roll paper 302 (simulating that the other hand presses the undrawn portion 322 of the roll paper), the drawn portion 321 can be torn off only by pulling the drawn portion 321 with a little force at a faster speed, thus realizing the operation of tearing off the paper towel with one hand, which is convenient to use.

Referring to FIG. 7 to FIG. 11, the pressing arm component 9 includes a pressing rod 91, a lower part of the pressing rod 91 is hinged to the mounting base 22, and the pressing block 901 is connected to an upper part of the pressing rod 91, so that the structural design is reasonable. The pressing block 901 is in a vertical state when pressed on the paper towel roll 30, and the pressing block 901 is hinged to the upper part of the pressing rod 91 by ways of a rotating shaft 6, so that the pressing block 901 can adaptively rotate to the vertical state when pressed on the paper towel roll 30, which makes it convenient to use; the pressing block 901 is made of a PP material or an ABS material, with good wear resistance and long service life; a hinge block 92 is fixedly disposed at the lower part of the pressing rod 91, and the hinge block 92 is hinged to the mounting base 22; the pressing rod 91 is hollow, and a hinge member 7 configured for achieving a hinged connection with the pressing block 901 is inserted into the upper part of the pressing rod 91; the elastic member 5 is connected between the hinge block 92 and the mounting base 22, the elastic member 5 is a tension spring, one end of the elastic member 5 is connected to the hinge block 92, and the other end of the elastic member 5 is connected to the mounting base 22; clamping hooks are respectively disposed at both ends of the elastic member 5, and the elastic member is separately hooked with the mounting base 22 and the hinge block 92 by ways of the clamping hooks at both ends; and the mounting base 22 is provided with a first hook groove 8 hooked with one end of the elastic member 5, and the hinge block 92 is provided with a second hook groove 19 hooked with the other end of the elastic member 5.

Referring to FIG. 8 to FIG. 13, the hinge block 92 is in an inverted triangle, and the triangle formed by the hinge block 92 has a first apical angle portion 921, a second apical angle portion 922, and a base angle portion 923; a lower end of the pressing rod 91 is connected to the first apical angle portion 921; one end of the elastic member 5 is connected to the second apical angle portion 922; and the base angle portion 923 is hinged to the mounting base 22. Hinge shafts 924 are disposed on the hinge block 92; there are two hinge shafts 924 respectively disposed at two sides of the hinge block 92; hinge plates 221 are disposed on the mounting base 22, and hinge grooves 222 corresponding to the hinge shafts 924 are formed on the hinge plates 221; and the two hinge plates 221 are arranged opposite to each other, achieving stable hinge connection and flexible rotation. A convex rib 925 is disposed on the side of the hinge block 92 close to one of the hinge plates 221, another convex rib 925 is disposed on the side of the hinge block 92 close to the other hinge plate 221, and the convex ribs 925 are annular; the convex ribs 925 are integrally connected to the hinge shafts 924, which increases the structural strength of the hinge shafts 924, so that the hinge shafts 924 are less prone to deformation and breaking. Meanwhile, the convex ribs 925 can make the hinge block 92 less prone to displacement between the two hinge plates 221 along the axial direction of the hinge shafts 924, so that the structural stability is good; and the hinge plates 221 are provided with guide slopes 223 for guiding the hinge shafts 924 into the hinge grooves 222, so that the assembly difficulty is low, and the assembly cost is reduced.

Figure 10:
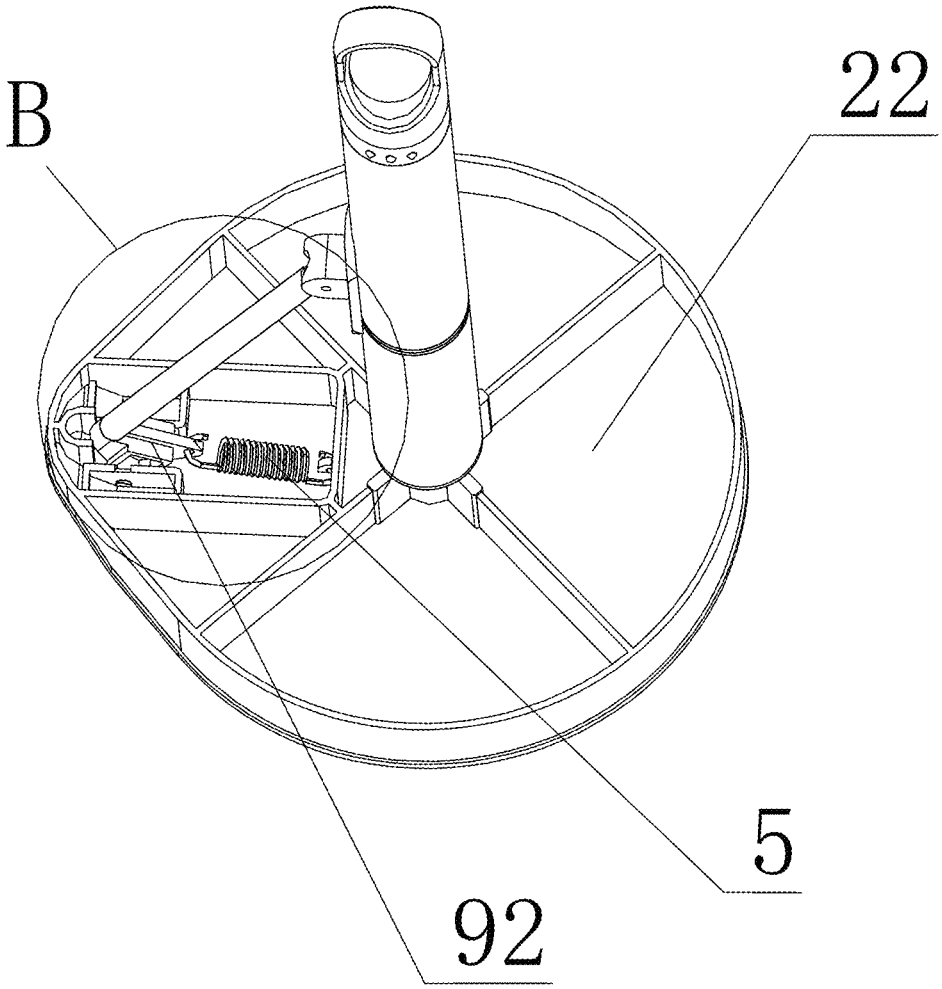
FIG. 10 is an internal schematic structural diagram of a mounting base according to the present disclosure.
Figure 11:
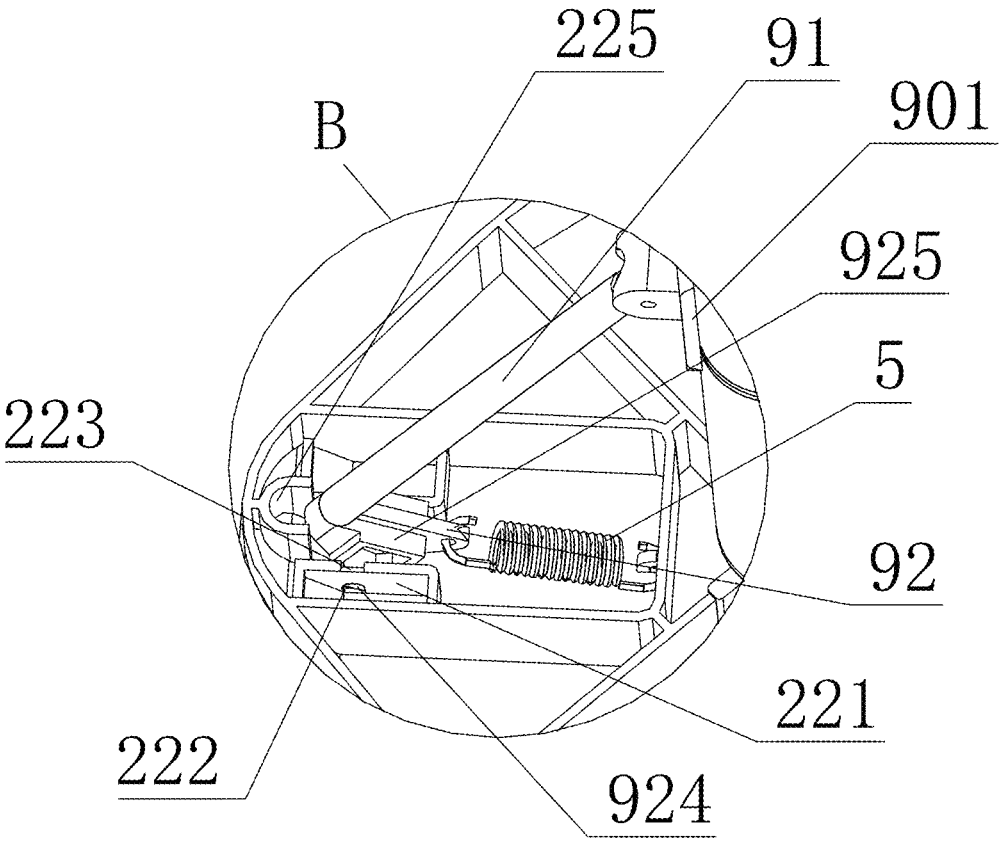
FIG. 11 is an enlarged view of Part B in FIG. 4.
Figure 12:
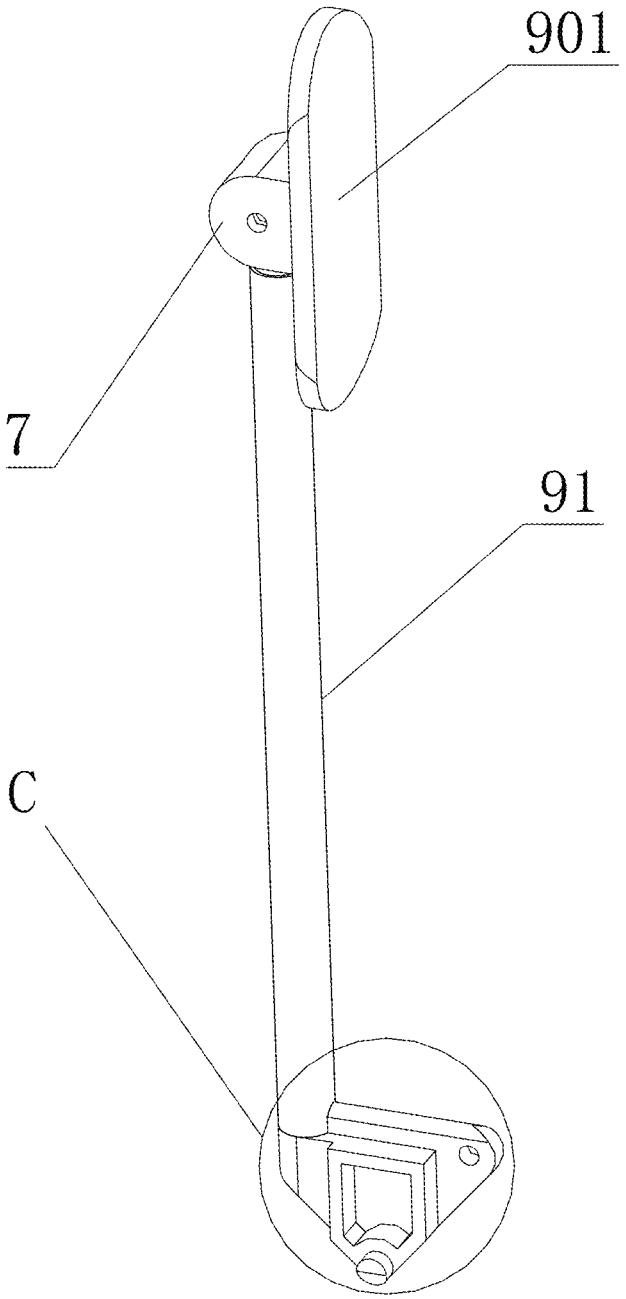
FIG. 12 is a schematic structural diagram of a pressing arm component according to the present disclosure.
Figure 13:
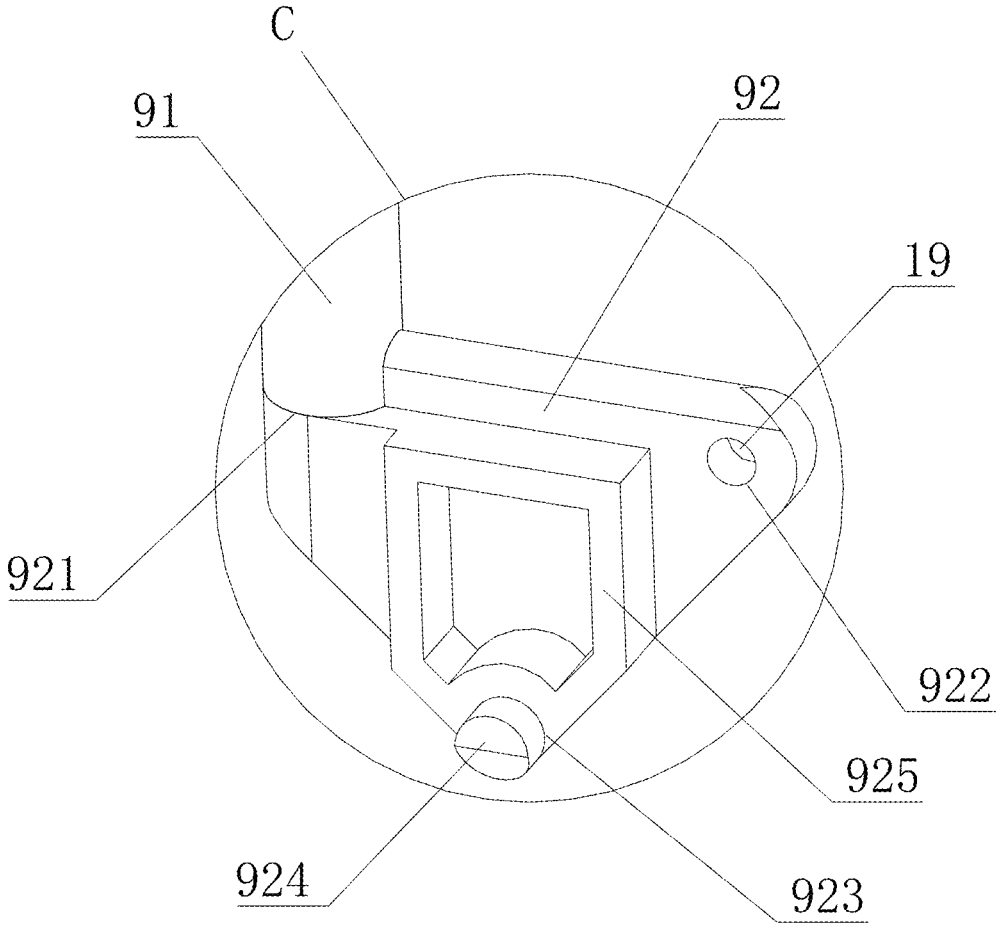
FIG. 13 is an enlarged view of Part C in FIG. 6.
Figure 14:
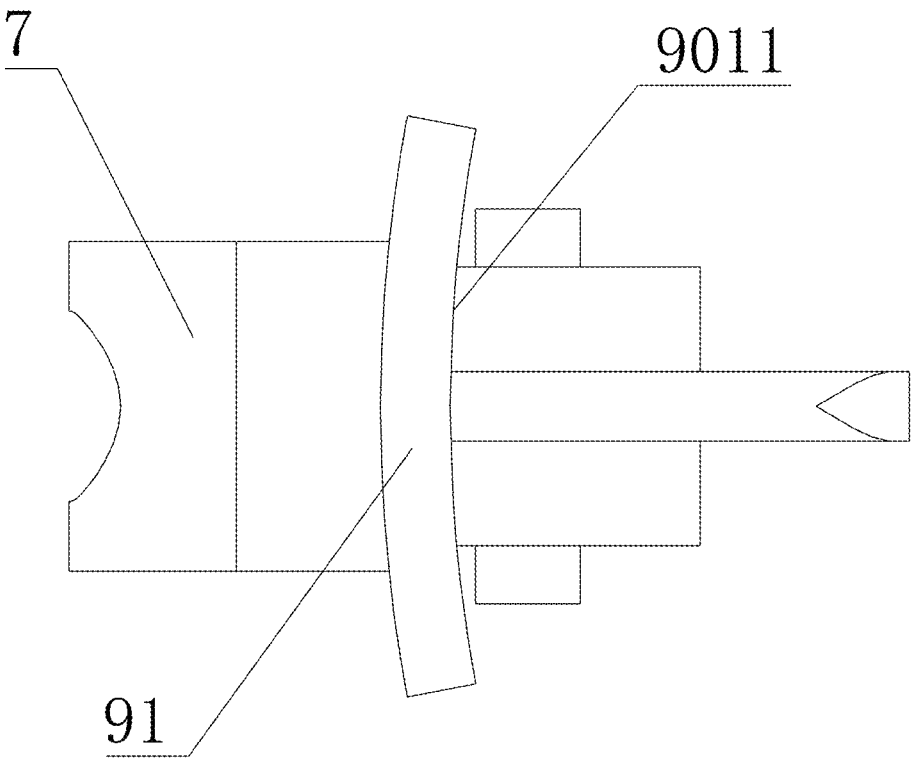
FIG. 14 is a schematic structural diagram of an arc-shaped concave part according to the present disclosure.
Figure 15:
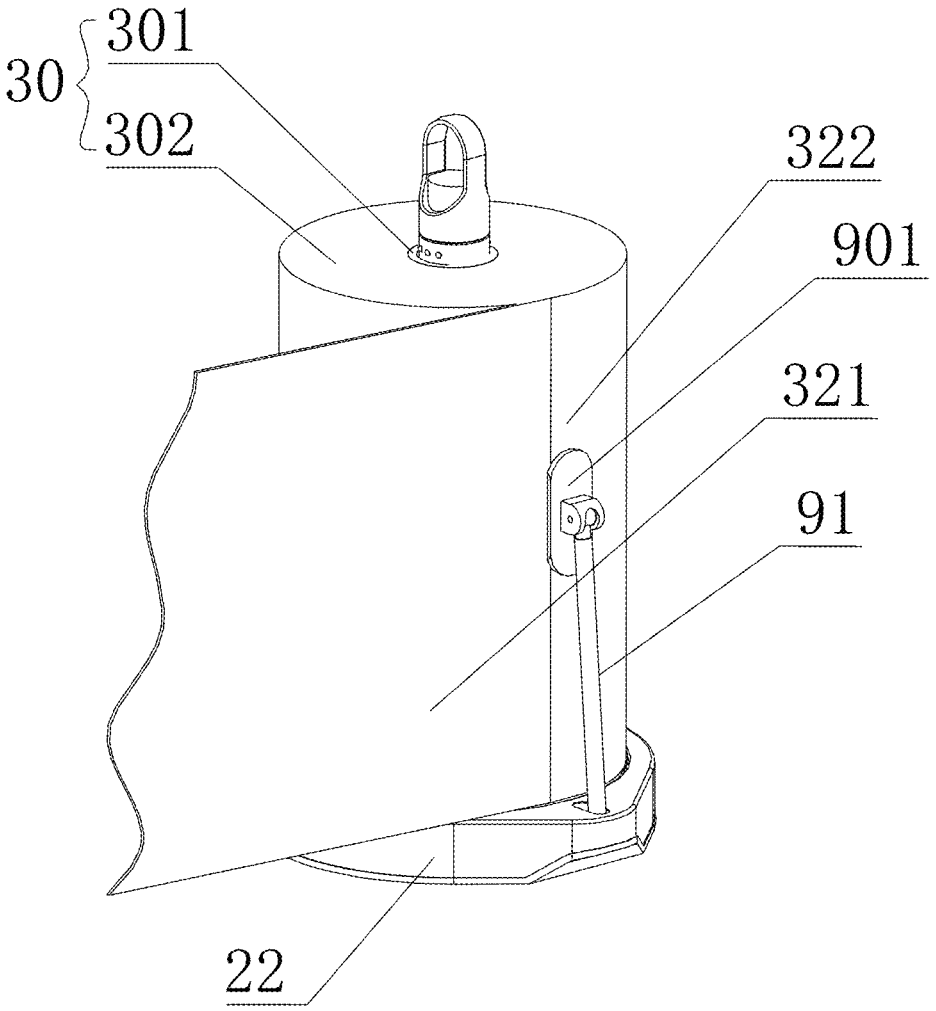
FIG. 15 is a schematic structural diagram of a paper towel rack according to the present disclosure when in use.
Figure 16:
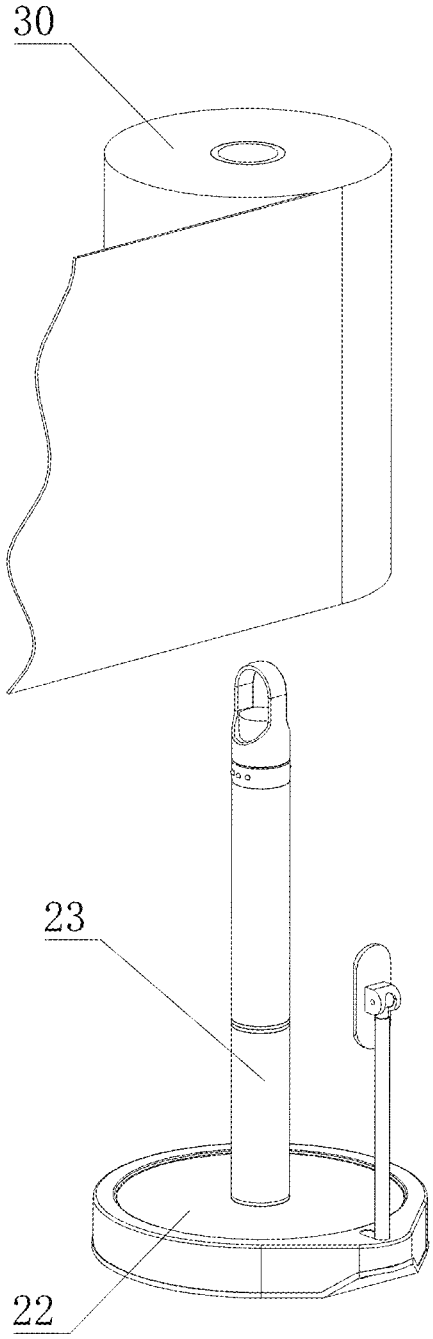
FIG. 16 is a schematic structural diagram of a paper towel rack according to the present disclosure when a paper towel roll is taken out.

Referring to FIG. 8 to FIG. 12, the hinge block 92 is provided with a first inclined surface 926, the mounting base 22 is provided with a second inclined surface 224 abutting against the first inclined surface 926 for limiting, the pressing rod 91 is cylindrical, and the mounting base 22 is provided with an arc-shaped concave surface 225 abutting against a side wall of the pressing rod 91 for limiting. Referring to FIG. 10, when the paper towel roll 30 is replaced, it is necessary to turn over the pressing arm component towards the side away from paper towel roll 30, so that the old paper towel roll 30 is taken out upward and replaced with a new paper towel roll. When turning over towards the side away from the paper towel roll 30 to a maximum angle, the pressing arm component is limited to avoid structural damage caused by the excessive rotation angle. At this time, the first inclined surface 926 and the second inclined surface 224 abut against each other for limiting, and the side wall of the pressing rod 91 and the arc-shaped concave surface 225 abut against each other for limiting. At this time, the pressing rod 91 is in a vertical state, and the structure is reliable.

In addition, this embodiment further provides a detachable connecting device, which is configured to achieve a detachable connection between the stand column 1 of the paper towel rack and the base 2. The detachable connecting device includes:

- a retaining eaves 11, formed at a bottom of the stand column 1;
- two clamping claws 41, respectively disposed at tops of the moving members 31 of the bouncing core device, the clamping claws 41 being hinged to the moving members 31, and the retaining eaves 11 being hooked by closing the two clamping claws 41; and
- second elastic deformation members 42, disposed at positions where the clamping claws 41 are located, the second elastic deformation members 42 being configured to keep the two clamping claws 41 open, where
- when the moving members 31 move downward relative to the first recessed structures 21 at a top of the stand column 1, side walls of the first recessed structures 21 are configured to close the two clamping claws 41.

It should be noted that the second elastic deformation members 42 herein may be torsion springs, or may be springs, as long as they can keep the two clamping claws 41 in an open state.

In addition, the two clamping claws 41 herein form the aforementioned clamping structure.

Specifically, when the stand column 1 is connected to the base 2, the two clamping claws 41 are kept in an open state under the action of the second elastic deformation members 42, the stand column 1 is placed on the moving members 31 between the two clamping claws 41 and pressed downward, and the moving members 31 drive the clamping claws 41 to move downward and enable the clamping claws to start to buckle when encountering the blocking of the side walls of the first recessed structures 21; and when the moving members 31 are pressed to the bottoms of the first recessed structures 21, exactly the two clamping claws 41 are stuck on the retaining eaves 11, and the retaining eaves 11 is used to prevent the clamping claws 41 from being detached from the stand column 1, so that the stand column 1 and the base 2 are connected together.

According to the present disclosure, the pressing arm component is pressed against one side of the paper towel roll by the elasticity of the elastic member, which generates friction force between the paper towel roll and the pressing arm component, and makes it difficult for the paper towel roll to continue rotating due to inertia when torn, thus avoiding waste caused by bringing out overmuch paper towel, and making it more convenient to use. The hinge plates are provided with the guide slopes for guiding the hinge shafts into the hinge grooves, which reduces assembly difficulty and lowers assembly cost. When turning over towards the side away from the paper towel roll to a maximum angle, the pressing arm component is limited to avoid structural damage caused by the excessive rotation angle. At this time, the first inclined surface and the second inclined surface abut against each other for limiting, and the side wall of the pressing rod and the arc-shaped concave surface abut against each other for limiting, making the structure reliable.

In this embodiment, the above-mentioned bouncing core device is skillfully combined with the two clamping claws 41 and the retaining eaves 11, so as to realize a brand new connection mode between the stand column 1 and the base 2; and the two clamping claws 41 and the retaining eaves 11 are quickly buckled or separated, thereby improving the sensitivity of the detachable connection between the stand column 1 and the base 2.

Further, each of the moving members 31 includes two vertical plates; the two clamping claws 41 are sandwiched between the two vertical plates, respectively; and the lateral moving member 33 is disposed between the two vertical plates.

Taking advantage of the large vertical contact areas of the vertical plates, on the one hand, the movable members 31 are connected to the clamping claws 41 more firmly; and on the other hand, the raised structures 34 are matched with the second recessed structures 35 more firmly, so as to prevent the raised structures 34 from detaching from the second recessed structures 35.

Preferably, each of the two clamping claws 41 is connected to the two vertical plates.

Further, the detachable connecting device further includes a left housing 43 and a right housing 44, where the left housing 43 and the right housing 44 are separately in a detachable connection with the top of the base 2, and the left housing 43 and the right housing 44 are buckled together; the first recessed structures 21 are respectively recessed downward from tops of the left housing 43 and the right housing 44; and the moving members 31 are disposed between the left housing 43 and the right housing 44. Preferably, the two second recessed structures may be provided at inner surfaces of the left housing 43 and the right housing 44, respectively.

With this arrangement, the assembly difficulty of the detachable connecting device is reduced, thereby improving the production efficiency the detachable connecting device. Preferably, each of the left housing 43 and the right housing 44 is detachably connected to the base 2 by ways of a threaded connecting member.

In addition, this embodiment also provides a paper towel rack, including the detachable connecting device. Due to the fact that the technical effect achieved by the paper towel rack is identical to that of the detachable connecting device, no further explanation will be provided.

The foregoing descriptions are merely exemplary implementations of the present disclosure. It should be pointed out that for those of ordinary skill in the art, some improvements and embellishments can also be made without departing from the technical principle of the present disclosure, and these improvements and embellishments should also be regarded as the protection scope of the present disclosure.

What is claimed is:

1. A bouncing core device, configured for a detachable connecting device disposed between a stand column (1) of a paper towel rack and a base (2), wherein the bouncing core device comprises:

moving members (31), disposed inside first recessed structures (21) at a top of the base (2), the moving members (31) being connected to the detachable connecting device;

first elastic deformation members (32), configured to push the moving members (31) upwards;

a lateral moving member (33), disposed at a position where the moving members (31) are located, the lateral moving member (33) being configured to move left and right, and first side faces of the lateral moving member (33) being arranged opposite to second side faces of the first recessed structures (21);

raised structures (34), formed at the first side faces or the second side faces; and second recessed structures (35), formed at the second side faces or the first side faces, each of the second recessed structures (35) being internally provided with a V-shaped bulge (351), bending portions of the V-shaped bulges (351) being arranged facing upward or downward, and the raised structures (34) being arranged inside the second recessed structures (35), wherein the second recessed structures (35) are configured to limit the raised structures (34) to move only clockwise or counterclockwise around edges of the V-shaped bulges (351), and a detachable connection between the stand column (1) and the base (2) can be achieved by ascending and descending of the moving members (31) relative to the first recessed structures (21).

2. The bouncing core device according to claim 1, wherein the cross sections of the raised structures (34) are rhombus-shaped, the cross sections of the raised structures (34) are vertical planes perpendicular to the protruding directions of the raised structures (34), and the length directions of the raised structures (34) are vertically arranged.

3. The bouncing core device according to claim 1, wherein the second recessed structures (35) are polygonal recessed structures, and each of the second recessed structures (35) is internally provided with a guide bulge (352); the guide bulges (352) are connected to side walls of the second recessed structures (35), the guide bulges (352) are arranged close to openings of the V-shaped bulges (351), and the guide bulges (352) protrude towards the openings of the V-shaped bulges (351); and the guide bulges (352) are configured to enable the raised structures (34) to enter the bending portions of the V-shaped bulges (351).

4. The bouncing core device according to claim 1, wherein there are two raised structures (34) and two second recessed structures (35); each of the raised structures (34) is arranged inside the corresponding second recessed structure (35); there are two first side faces arranged at two opposite side faces of the lateral moving member (33); and there are two second side faces arranged in one-to-one correspondence with the first side faces.

5. The bouncing core device according to claim 4, wherein each of the moving members (31) is provided with a long strip-shaped through hole (311), and the long strip-shaped through hole (311) extends horizontally; the lateral moving member (33) is placed inside the long strip-shaped through holes (311), and the two raised structures (34) are respectively formed at the corresponding first side faces and extend out of the long strip-shaped through holes (311); and the two second recessed structures (35) are respectively formed at the corresponding second side faces.

6. The bouncing core device according to claim 5, wherein the bending portions of the V-shaped bulges (351) are arranged facing upward.

7. The bouncing core device according to claim 1, wherein the base (2) comprises a mounting base (22), and a mounting column (23) fixedly disposed on the mounting base (22), the mounting column (23) is sleeved with a paper towel roll (30) in a detachable manner, the mounting base (22) is provided with a pressing arm component (9) for being pressed on one side of the paper towel roll (30), a pressing block (901) for being pressed on one side of the paper towel roll (30) is disposed at an upper part of the pressing arm component (9), and a lower part of the pressing arm component (9) is hinged to the mounting base (22); and an elastic member (5) is disposed between the pressing arm component (9) and the mounting base (22), and the pressing arm component (9) is driven by the elasticity of the elastic member (5) to rotate towards one side of the paper towel roll (30), so that the pressing block (901) is pressed against the paper towel roll (30).

8. The bouncing core device according to claim 7, wherein the pressing arm component (9) comprises a pressing rod (91), a lower part of the pressing rod (91) is hinged to the mounting base (22), and the pressing block (901) is connected to an upper part of the pressing rod (91).

9. The bouncing core device according to claim 8, wherein the pressing block (901) is hinged to the upper part of the pressing rod (91).

10. The bouncing core device according to claim 8, wherein a hinge block (92) is fixedly disposed at the lower part of the pressing rod (91), and the hinge block (92) is hinged to the mounting base (22).

11. The bouncing core device according to claim 10, wherein the elastic member (5) is connected between the hinge block (92) and the mounting base (22), the elastic member (5) is a tension spring, one end of the elastic member (5) is connected to the hinge block (92), and the other end of the elastic member (5) is connected to the mounting base (22).

12. The bouncing core device according to claim 11, wherein the hinge block (92) is in an inverted triangle, and the triangle formed by the hinge block (92) has a first apical angle portion (921), a second apical angle portion (922), and a base angle portion (923); a lower end of the pressing rod (91) is connected to the first apical angle portion (921); one end of the elastic member (5) is connected to the second apical angle portion (922); and the base angle portion (923) is hinged to the mounting base (22).

13. The bouncing core device according to claim 11, wherein hinge shafts (924) are disposed on the hinge block (92), hinge plates (221) are disposed on the mounting base (22), and hinge grooves (222) corresponding to the hinge shafts (924) are formed on the hinge plates (221).

14. The bouncing core device according to claim 13, wherein convex ribs (925) are disposed on the sides of the hinge block (92) close to the hinge plates (221), and the hinge plates (221) are provided with guide slopes (223) for guiding the hinge shafts (924) into the hinge grooves (222).

15. The bouncing core device according to claim 10, wherein the hinge block (92) is provided with a first inclined surface (926), the mounting base (22) is provided with a second inclined surface (224) abutting against the first inclined surface (926) for limiting, the pressing rod (91) is cylindrical, and the mounting base (22) is provided with an arc-shaped concave surface (225) abutting against a side wall of the pressing rod (91) for limiting.

16. The bouncing core device according to claim 7, wherein the mounting column (23) is in a detachable threaded connection with the mounting base (22) by ways of a first bolt (20) disposed at a bottom of the mounting column, and the stand column (1) is in a detachable threaded connection with the mounting column (23) by ways of a second bolt (200) disposed at a bottom of the stand column.

17. A detachable connecting device comprising:

the bouncing core device according to claim 1;

a retaining eaves (11) formed at a bottom of the stand column (1);

two clamping claws (41), respectively disposed at tops of the moving members (31) of the bouncing core device, the clamping claws (41) being hinged to the moving members (31), and the retaining eaves (11) being hooked when the two clamping claws (41) are closed; and second elastic deformation members (42), disposed at positions where the clamping claws (41) are located, the second elastic deformation members (42) being configured to keep the two clamping claws (41) open, wherein when the moving members (31) move downward relative to the first recessed structures (21) at a top of the stand column (1), side walls of the first recessed structures (21) are configured to close the two clamping claws (41).

18. The detachable connecting device according to claim 17, wherein each of the moving members (31) comprises two vertical plates; the two clamping claws (41) are sandwiched between the two vertical plates, respectively; and the lateral moving member (33) is disposed between the two vertical plates.

19. The detachable connecting device according to claim 18, wherein the detachable connecting device further comprises a left housing (43) and a right housing (44), the left housing (43) and the right housing (44) are separately in a detachable connection with the top of the base (2), and the left housing (43) and the right housing (44) are buckled together; the first recessed structures (21) are respectively recessed downward from tops of the left housing (43) and the right housing (44); and the moving members (31) are disposed between the left housing (43) and the right housing (44).

20. A paper towel rack comprising:

the detachable connecting device according to claim 17.

* * * * *